United States Patent [19]

Harvill

[11] Patent Number: 4,534,403

[45] Date of Patent: Aug. 13, 1985

[54] HOT CHAMBER DIE CASTING MACHINE

[76] Inventor: John I. Harvill, 24201 Orange Ave., Perris, Calif. 92370

[21] Appl. No.: 485,653

[22] Filed: Apr. 18, 1983

Related U.S. Application Data

[63] Continuation-in-part of Ser. No. 386,340, Jun. 8, 1982, Pat. No. 4,476,912, which is a continuation of Ser. No. 196,319, Oct. 14, 1980, abandoned.

[51] Int. Cl.[3] ..... B22D 17/02

[52] U.S. Cl. ..... 164/316; 164/348

[58] Field of Search ..... 164/312, 314, 316, 317, 164/318, 348

[56] References Cited

U.S. PATENT DOCUMENTS

| | | | |
|---|---|---|---|
| 2,244,816 | 6/1941 | Lynn | 164/314 |
| 3,960,201 | 6/1976 | Portalier | 164/312 |
| 4,154,288 | 5/1979 | Borgen | 164/312 |
| 4,311,185 | 1/1982 | Zimmerman | 164/312 |
| 4,334,575 | 6/1982 | Miki et al. | 164/312 |

FOREIGN PATENT DOCUMENTS

| | | | |
|---|---|---|---|
| 574213 | 12/1945 | United Kingdom | 164/316 |

*Primary Examiner*—Nicholas P. Godici
*Assistant Examiner*—Chris McKee
*Attorney, Agent, or Firm*—Lyon & Lyon

[57] ABSTRACT

A hot chamber die casting machine employing a substantially horizontally arranged charging cylinder and piston. The piston employs a charging head, a sealing head and a rigid member therebetween. The device is arranged to allow access to the piston for changing rings and the like without substantial loss of material from the pot. A safety cover is provided with doors which do not remain open without external support. A cooling system is shown to reduce the temperature of the seal at the open end of the cylinder so that the material within the pot will partially or completely solidify to form an improved seal.

22 Claims, 12 Drawing Figures

FIG. 9
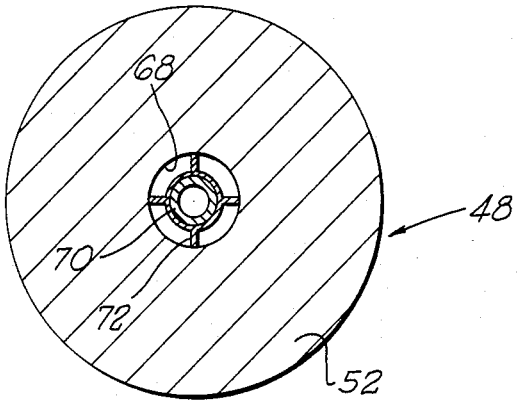
FIG. 10
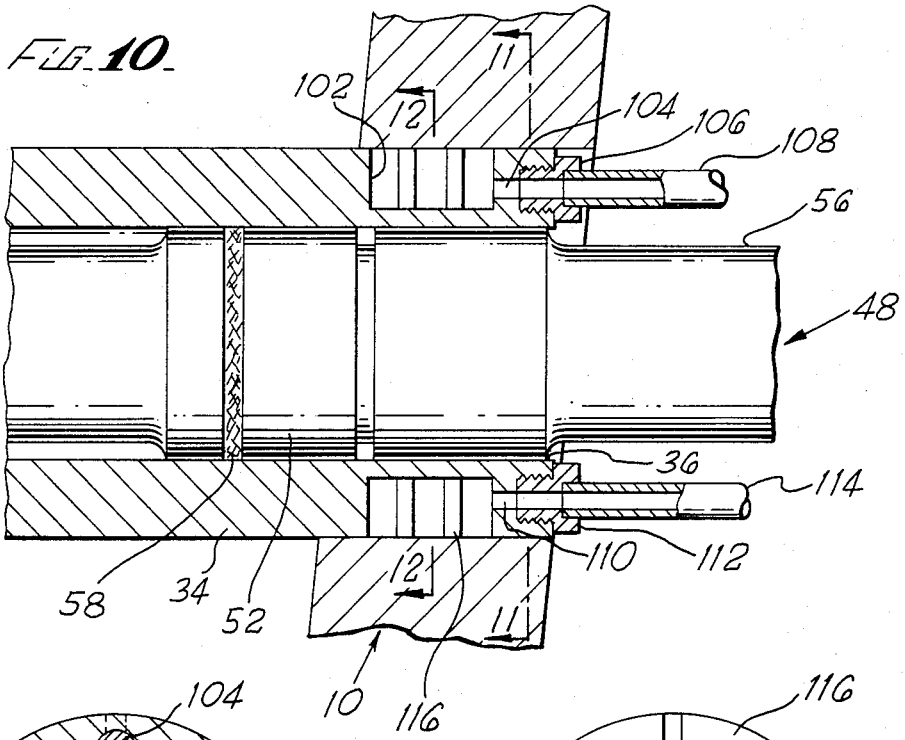
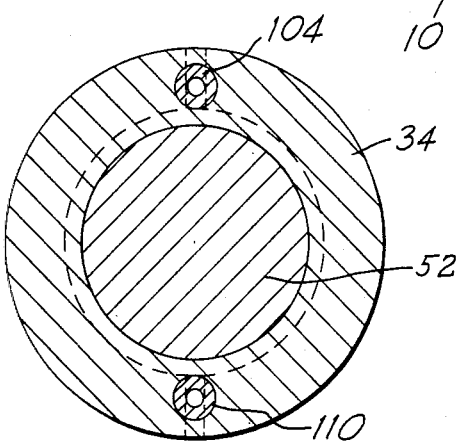
FIG. 11
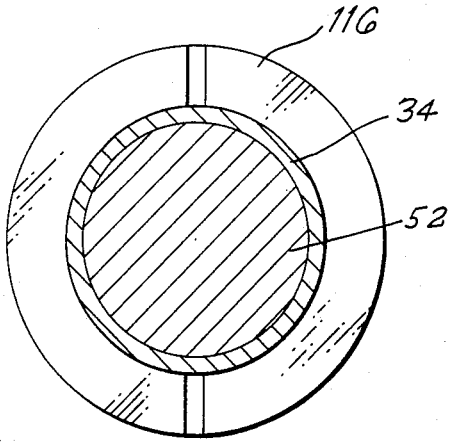
FIG. 12

HOT CHAMBER DIE CASTING MACHINE

CROSS REFERENCES TO RELATED APPLICATION

This is a continuation-in-part of U.S. patent application Ser. No. 386,340, filed Jun. 8, 1982, now issued as U.S. Pat. No. 4,476,912, which is in turn a continuation of U.S. patent application Ser. No. 196,319, filed Oct. 14, 1980 and now abandoned.

BACKGROUND OF THE INVENTION

The present invention relates to die casting machinery and specifically hot chamber die casting machinery.

Hot chamber die casting machines generally include a hot chamber or pot in which the material which is to be used in the casting process is contained. This material, which is kept in the molten state, is automatically drawn into a die charging device which is at least partially submerged within the molten metal. Thus, there is no ladling of molten material to the die as with certain other casting processes. The automatic charging is, of course, most advantageous; however, certain limitations are placed on the charging mechanism.

Conventional charging mechanisms generally employ a plunger operating through a vertical cylinder. To direct the casting material to the die from the vertical cylinder, a gooseneck is employed which conveys the material to a position above the level of the molten supply and outwardly over the rim of the pot to the die location. The vertical orientation of the charging cylinder ensures that the driving mechanism is located above the pot. In this way, the plunger may be easily pulled without requiring a first draining of the pot; and sealing problems are minimized.

In spite of the advantages associated with the vertical arrangement, certain inherent difficulties also exist. The gooseneck required with a vertically arranged cylinder exhibits a substantial pressure loss with the casting material being forced at sufficient speed to reach all portions of the die quickly. The orientation of the charging cylinder also requires that the gooseneck extend over a substantial distance. This results in a cooling of the charged material prior to its reaching the die if some form of additional heating is not provided. To overcome the cooling problem, the gooseneck does not extend to the die. Instead, a nozzle is provided to span a substantial distance between the gooseneck and the die. The nozzle is then kept warm by means of torches directed at the nozzle. This arrangement better maintains the material at the appropriate temperature but results in the very rapid erosion of the nozzle.

The location of the vertical plunger above the pot which cooperates with the vertical charging cylinder also exhibits an inherent disadvantage. The vertical plunger tends to interfere with proper access to the pot of molten material for replenishing the pot. This can result in the improper removal of the pot covers by workers who are not exercising reasonable care for their own safety. Removal of these covers provides added convenience for the workers in replenishing the pot. However, adding solid material to the molten reservoir can result in splashing and the like which could possibly endanger the worker. Consequently, conventional systems, albeit safe, can be used improperly and thereby endanger the irresponsible worker.

SUMMARY OF THE INVENTION

The present invention is directed to hot chamber die casting machines and employs a substantially horizontal charging cylinder which extends through rather than down into the pot. The horizontal orientation of the cylinder reduces certain of the difficulties associated with vertically oriented charging cylinders. For example, the horizontal cylinder eliminates the pressure loss attributed to the reversal of the charged material required in the gooseneck. Furthermore, the extended distance required for the material to travel through the gooseneck is substantially reduced. As a result, the nozzle extending between the charging device and the die becomes optional rather than mandatory. Finally, with a substantially horizontal charging cylinder the plunger mechanism is no longer positioned above the pot. As a result, a cover may be employed which the careless worker is less likely to remove.

To ensure convenient operation of the charging cylinder and its associated piston, a piston is employed which has two heads spaced axially from one another. The head closest to the die operates as the charging head to force material into the die. The other head is employed as a sealing mechanism to prevent molten material from escaping from behind the charging head and out of the pot.

To promote sealing of the pot about the piston, cooling of the rearward portion of the charging cylinder is employed to create a semi or fully solidified metal barrier. This cooling may either be accomplished through the cylinder or surrounding pot or through the piston. Many fluids may be used; but water is generally most convenient. The cooling fluid may be circulated to cause molten metal within the pot to solidify at the sealing portion of the piston. This is particularly true of metal leaking past the piston. Hence, selective solidification is accomplished where needed to provide an effective seal.

The charging arrangement of the present invention may employ a mechanism useful for servicing the piston without requiring a draining of the pot. A pressure relief port rearwardly of the charging head is positioned such that it will become covered over before the sealing head is fully extracted from the charging cylinder. Consequently, only a small amount of molten material will be present or available to escape from behind the charging head when the piston is withdrawn from the charging cylinder. This small amount of material escapes to a gutter which is provided beneath the rear end of the charging cylinder. Because of the small amount of material allowed to escape from the cylinder, the piston may be retracted for servicing of the seals without substantial loss. For such servicing, the piston may be finally retracted to a point where the charging head remains in the charging cylinder only forward of the seals located peripherally about the charging head. Albeit the sealing capacity of the head is reduced as the rings are retracted from the charging cylinder, the condition of the molten material ahead of the charging piston at this time is not under pressure. Thus, the close tolerance of the piston itself within the charging cylinder provides an adequate seal to allow convenient work on the sealing device around the charging head.

A cover having ports therethrough for replenishing of the pot is here employed. The cover includes doors over the ports which are designed to only partially open and to close automatically when not externally propped. In this way, splash is eliminated without the inconvenience which might otherwise tempt a careless worker to remove the cover.

Accordingly, it is an object of the present invention to provide an improved hot chamber die casting machine. Other and further objects and advantages will appear hereinafter.

BRIEF DESCRIPTION OF THE DRAWINGS

FIG. 9 is a cross-sectional view taken along line 9—9 of FIG. 7.

FIG. 10 is a detailed cross-sectional elevation of the charging cylinder illustrating a second cooling system.

FIG. 11 is a cross-sectional view taken along line 11—11 of FIG. 10.

FIG. 12 is a cross-sectional view taken along line 12—12 of FIG. 10.

DETAILED DESCRIPTION OF THE PREFERRED EMBODIMENT

Figure 1:
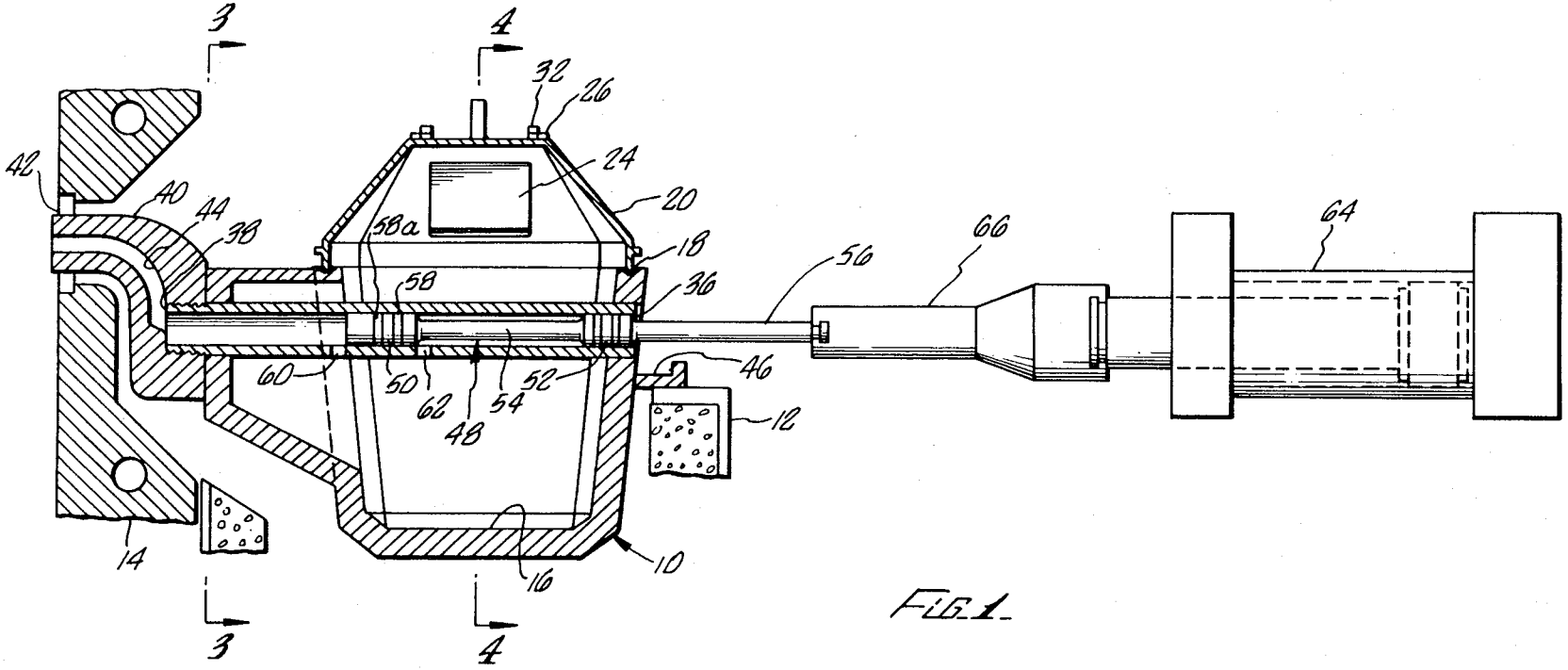
FIG. 1 is a side view of the present invention with the pot and charging cylinder illustrated in vertical cross section.
Figure 2:
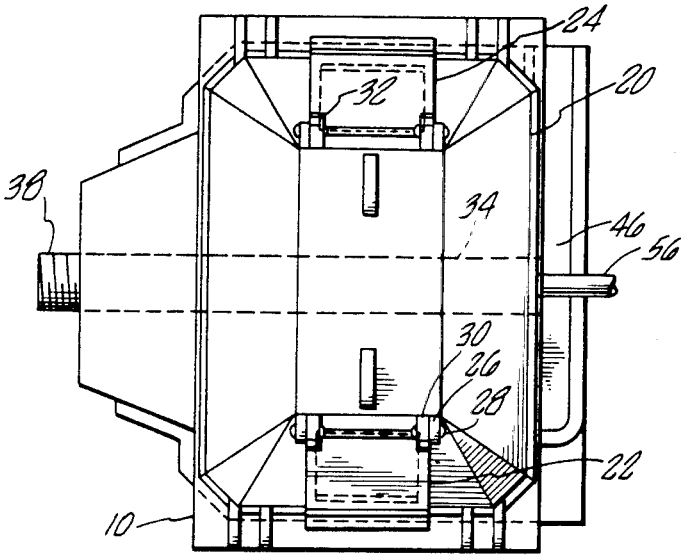
FIG. 2 is a plan view of the present invention.
Figure 3:
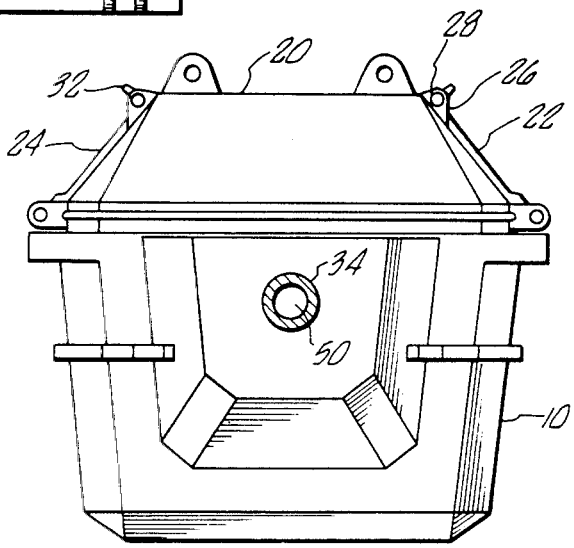
FIG. 3 is a front view of the present invention taken along 3—3 of FIG. 1.

Turning in detail to the drawings, a hot chamber die casting machine is illustrated including a pot 10 shown in position in a furnace 12 and extending to a fixed platen 14. The overall shape of the pot 10 is designed to accomodate existing facilities employing more conventional systems. A central cavity 16 contains the molten material used in the casting process. The central cavity 16 extends forward toward the fixed platen 14 such that the molten material will aide in keeping the forward portions of the mechanism hot. The upper surface of the pot 10 includes a groove 18 for receiving a cover 20. The cover 20 completely encloses the upper portion of the pot 10 and may be arranged to accommodate an inert gas shield therein.

Figure 4:
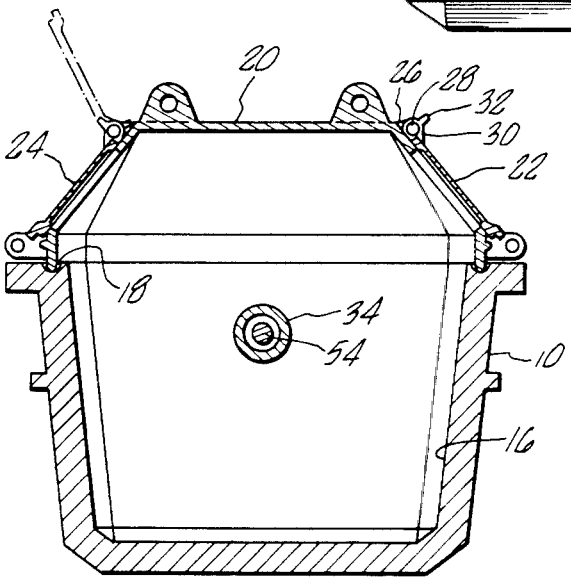
FIG. 4 is a cross-sectional elevation taken along line 4—4 of FIG. 1.

The cover 20 includes access to the pot without removal of the cover through two pivotally mounted doors 22 and 24. The doors are pivotally mounted to lugs 26 by means of pins 28. Two lugs 30 are provided on each door for cooperation with the pins 28 and the lugs 26 on the cover 20. The lugs 30 include stop means in the form of upstanding fingers 32 which interefere with the full pivotal movement of the doors 22 and 24 about the pins 28. The full open condition of the doors 22 and 24 as constrained by the fingers 32 is shown in phantom in FIG. 4. The position of the fingers 32 is such that the center of gravity of the doors 22 and 24 cannot cross over the top of the pins 28 such that the doors would remain open without external propping. Consequently, unless propped, the doors automatically close. The doors are positioned on the cover 20 such that they are accessible from the sides of the pot 10. This of course aids in the facile replenishing of casting material to the pot 10.

Located through the pot 10 in a substantially horizontal position is a charging cylinder 34. The charging cylinder 34 has a first open end 36 extending out of what may be considered the back side of the pot 10. The second or other open end 38 extends from the pot 10 through the forward side thereof. Thus, neither end of the cylinder 34 is located within the pot 10.

The second open end 38 includes a mechanism for attaching a nose 40 thereon. The mechanism illustrated is shown in the present embodiment to be a simple threaded mating of the nose 40 with the end 38 of the charging cylinder 34. The nose 40 extends from the second open end 38 of the charging cylinder 34 upwardly to a position above the fluid level of the material contained within the pot 10 and forwardly to a position at the die inlet 42. A passage 44 thus communicates material from within the charging cylinder 34 to the die. The distance covered by the passage 44 is preferably maintained at a minimum to prevent unnecessary cooling of the material passing therethrough. The nose 40 also shares a substantial common interface with the forward side of the pot 10 in order that heat will be conducted from the pot 10 to warm the nose 40.

Located immediately below the first open end 36 of the charging cylinder 34 is a gutter 46. The gutter 46 is designed to catch and drain off any molten material which might be discharged from the first open end 36 of the charging cylinder 34.

Positioned within the charging cylinder 34 is a piston 48. The piston 48 is employed in the operation of the charging mechanism between a retracted position as shown in FIG. 1 and a forward or extended position when charging of the die is complete. For service of the piston 48, the piston 48 may be withdrawn through the first end 36 of the charging cylinder 34 to an extracted or service position exposing the sealing mechanism as will be discussed below.

The piston 48 includes a first or charging head 50, a second or sealing head 52 and a rigid connecting member 54 between the two heads 50 and 52. The heads 50 and 52 and the rigid connecting member 54 are integrally formed in this embodiment. Also integrally formed with the piston 48 is a connecting rod 56 which is of sufficient length to extend from the first open end 36 of the charging cylinder 34 with the piston 48 in its fully forward position toward the nose 40. The charging head 50 and the sealing head 52 both are sized to fit closely within the charging cylinder 34 and further include sealing means located about the periphery of the heads. The sealing means include rings 58 which provide additional sealing capability particularly for the charging head 50 which experiences substantial fluid pressure from the material being forced into the die. A significant length of the forward end of the charging head 50 is located in front of the first ring **58*a*. This portion of the head 50 in front of the first ring 58*a* is designed to remain within the charging cylinder 34 when in the extracted or service position to help seal the cylinder with the first ring 58*a* exposed for replacement as will be discussed below. The back ring 58 may be omitted when the cooling system described below is employed. Thus, the piston 48 is slidably mounted to closely fit within the charging cylinder 34. The rigid connecting member 54 between the two heads 50 and 52 may be of an appropriate diameter. However, the larger the diameter of this member 54, the less molten material is retained in the annular space between the member 54 and the charging cylinder 34**.

Means are provided for charging the cylinder 34 with molten material. Charging is accomplished through a port 60 in the cylinder wall at a position between the piston 48 and . the first open end 36 when the piston is in its retracted position. As the level of molten material within the pot 10 is maintained above cylinder 34, the molten material will flow through port 60 into the interior of the charging cylinder 34 between charging strokes of the piston 48. A second, relief port 62 is provided between the charging head 50 and the sealing head 52. The charging head 50 and the sealing head 52 are spaced far enough apart so that during the normal operation of the piston 48, neither head passes over the relief port 62. The relief port 62 provides pressure relief for any pressurized material flowing around the rings on the charging head 50. The pressurization results from the pressure induced in the material ahead of the piston 48 when the die is being charged. The relief port 62 is also positioned near the back portion of the charging head 50 so that this port will be covered over fairly quickly as the piston 48 is retracted from the charging cylinder 34.

Connected to the piston 48 is a means for forcing the piston axially to charge the die and to return the piston for successive strokes. This means is provided in the present embodiment by a hydraulic cylinder 64. A rigid link 66 is positioned between the piston of the hydraulic cylinder 64 and the piston 48. The connecting rod 56 and the piston of the hydraulic cylinder 64 are such that the rigid link 66 may be removed, the piston of the hydraulic cylinder 64 extended and the connecting rod 56 connected directly to the piston of the hydraulic cylinder 64. By then retracting the hydraulic cylinder, the piston 48 is drawn from the charging cylinder 34. By selecting the appropriate length of the rigid link 66, full retraction of the hydraulic cylinder 64 will leave the front portion of the charging head 50 in the charging cylinder 34 with the rings 58 fully exposed for replacement. This is accomplished by making the effective length of the rigid link 66 between the couplings at either end equal to the distance between the first end of the charging cylinder 34 on the side of the pot 10 adjacent the hydraulic cylinder 64 and the far side of the leading ring 58*a* on the charging head 50.

To enhance the sealing capability of the piston sealing head 52, a means for cooling the area at the open end 36 of the charging cylinder 34 is provided as shown in FIGS. 5–12. Two embodiments are illustrated and many more are possible. In the first of these embodiments illustrated in FIGS. 5–9, a cooling circulation system is positioned in the piston 48. In the second embodiment, FIGS. 10–12, a coolant circulation system is positioned about the cylinder 34 rather than about the piston 48. In either case, it is the object of the cooling means to maintain a temperature at the seal between the sealing head 52 and the cylinder 34 which is substantially at or below the melting point of the die casting material contained within the pot 10. The remaining portions of the pot, the piston and cylinder are maintained at a temperature above the melting point of the material contained within the pot.

Figure 5:
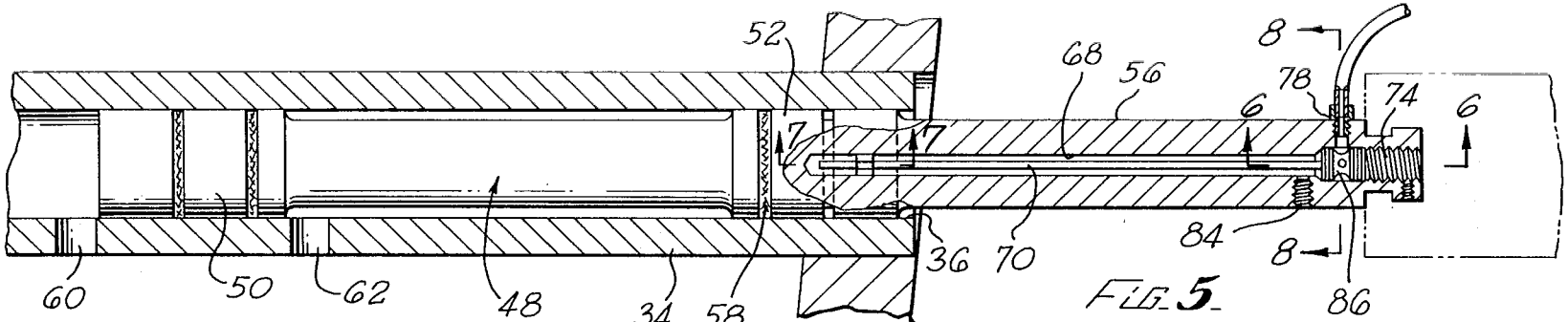
FIG. 5 is a detailed cross-sectional elevation of the charging cylinder illustrating a first cooling system.
Figure 6:
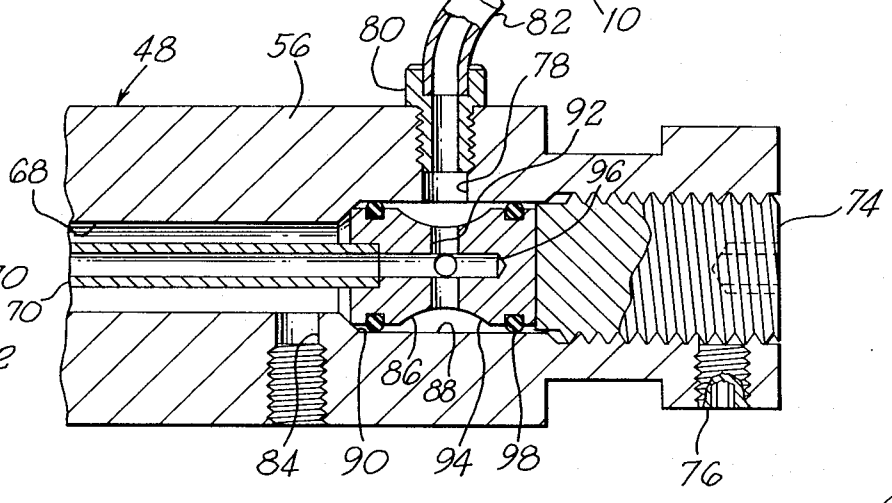
FIG. 6 is a cross-sectional view taken along line 6—6 of FIG. 5.
Figure 7:
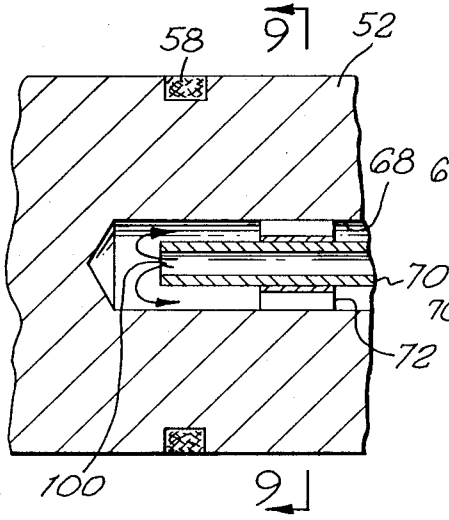
FIG. 7 is a cross-sectional view taken along line 7—7 of FIG. 5.
Figure 8:
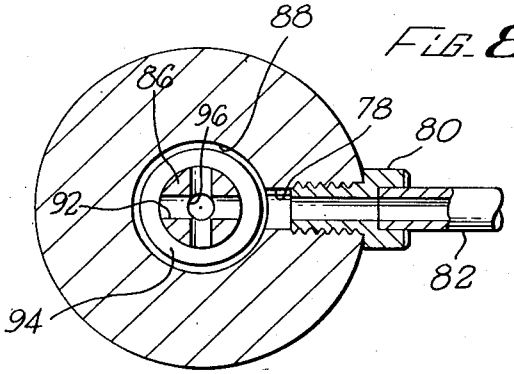
FIG. 8 is a cross-sectional view taken along line 8—8 of FIG. 5.

Looking then to the first embodiment, and particularly FIG. 5, a central bore 68 is positioned along the length of the connecting rod 56 and into the sealing head 52 of the piston 48. A hollow tube 70 is concentrically arranged within the central bore 68 and extends, as can be seen in FIG. 5, substantially the length of the central bore 68. A spacer element 72 fixed to the hollow tube 70 near its distal end insures proper concentric positioning of the hollow tube 70 in the central bore 68.

The end of the central bore, at the end of the piston, is fitted with a plug 74 threaded therein. A locking screw 76 insures retention of the plug 74. To provide access to the cooling system, an inlet 78 extends laterally from the connecting rod 56 of the piston 48. A hose fitting 80 is threaded into the inlet 78 for convenient receipt of a supply hose 82. An outlet 84 also extends laterally from the central bore and is displaced longitudinally along the bore 68 for convenience of flow direction. It is preferable that the outlet 84 is located on the bottom of the piston 48 as it is arranged in the die casting machine in order that the central bore may be drained if and when that is desired. The outlet 84 is also threaded to receive a hose coupling where desired.

A manifold 86 is positioned in the central bore 68. A widened portion 88 of the central bore 68 is provided for receipt of the manifold 86 and includes a truncated conical shoulder 90 to mate with a matching male surface on the manifold 86. This shoulder thus centers the manifold 86 when the manifold is forced thereagainst by means of the plug 74.

The manifold 86 includes laterally extending passages 92 positioned centrally through the body thereof. Surrounding these passages is an annular channel 94 illustrated in this embodiment to be cut into the body of the manifold 86. The passages 92 also lead to an axial passage 96 which is concentric with the hollow tube 70. A socket is provided in the manifold 86 for receipt of the proximal end of the hollow tube 70 as can best be seen in FIG. 6. In this way, the passages 92 and 96 in cooperation with the channel 94 direct incoming flow through the inlet 78 to the interior of the hollow tube 70. O-rings 98 provide a seal about the channel 94 to prevent bypass flow into the remaining portion of the central bore 68.

The cooling fluid, which may most conveniently be water, is directed through the inlet 78 and the manifold 86 into the hollow tube 70. At the distal end of the hollow tube 70 a port 100 allows the flow to enter the main central bore 68 about the hollow tube 70. Thus, the hollow tube 70 simply provides a means for directing coolant to the location where cooling is to occur, namely, the sealing head 52. Flow is then directed substantially uniformly back away from the sealing head 52 in the annular space about the hollow tube 70 to the outlet 84. In order to conserve coolant, a pump is preferred for simply recycling the coolant to the inlet 78. A radiator or holding tank may be used to reduce the temperature of the effluent from outlet 84 prior to its reintroduction at inlet 78.

Looking then to the second embodiment of FIGS. 10–12, an annular cavity 102 is cut into the charging cylinder 34 inwardly of the wall of the pot 10. This annular cavity is thus adjacent the open end 36 of the charging cylinder 34. An inlet 104 is directed to the annular cavity 102 and is threaded to receive a fitting 106 for a tube or hose 108. Likewise, an outlet 110 is provided with a similar fitting 112 and return line 114. Baffles 116 are positioned in the cavity to insure proper distribution of the flow between the inlet 104 and the diametrically opposed outlet 110. In this instance, the piston may or may not have the cooling system of FIGS. 5–9 depending on the cooling requirements. Again, water is most conveniently used as the coolant and may be recirculated through a heat exchange device by means of a pump.

Looking then to the operation of the mechanism, the piston 48 normally operates within the charging cylinder 34 such that the sealing head 52 does not leave the charging cylinder 34. As the piston 48 is forced forward, the charge within the forward portion of the charging cylinder 34 is forced to the die. As the piston is retracted back behind the port 60, new material may flow into the charging cylinder 34. As mentioned above, if pressure leakage around the seals of the charging head 50 is present, this pressure is relieved through the relief port 62 and no material ever passes beyond the sealing head 52.

When the piston 48 requires service, the rigid link 66 is removed as mentioned above and the piston 48 is drawn rearwardly from the charging cylinder 34. As this occurs, the sealing head 52 is first to leave the charging cylinder 34. By the time that the seal with the sealing head 52 is lost, the relief port 62 is covered over by the charging head 50. The small amount of molten material around the rigid connecting member 54 then drains into the gutter 46 harmlessly. Further retraction of the piston 48 then exposes the rings 58 on the charging head 50. In this way, the rings on the charging head 50 and on the sealing head 52 may be changed without emptying the pot. The portion of the charging head 50 in front of the rings 58 provides a sufficient seal for this operation. The piston 48 may then be slowly forced forward to its operative position without substantial loss of casting material.

Thus, an improved hot chamber die casting machine is disclosed which avoids the difficulties associated with vertically oriented charging cylinders and provides other advantageous and convenient features. While embodiments and applications of this invention have been shown and described, it would be apparent to those skilled in the art that many more modifications are possible without departing from the inventive concepts herein described. The invention, therefore, is not to be restrictive except in the spirit of the appended claims.

What is claimed is:

1. A hot chamber die casting machine comprising a pot;

a cylinder extending horizontally through said pot and having a first, open end on a first outer side of said pot;

a piston slidably mounted in said cylinder;

means for cooling said first, open end and no other part of said cylinder to a temperature below the melting point of metal die casting material.

2. The hot chamber die casting machine of claim 1 wherein said cooling means is a fluid circulation system in said piston.

3. The hot chamber die casting machine of claim 1 wherein said cooling means includes a fluid circulation system in said cylinder.

4. The hot chamber die casting machine of claim 2 wherein said fluid circulation system includes a central bore in said piston, a hollow tube positioned concentrically in said bore and extending substantially the length thereof, an inlet to the center of said hollow tube, a port in said hollow tube near a first end of said central bore and an outlet from said central bore near a second end of said central bore.

5. The hot chamber die casting machine of claim 3 wherein said fluid circulation system includes an annular cavity about the bore of said cylinder adjacent said first, open end and inwardly of the wall of said pot, an inlet to said annular cavity, and an outlet from said annular cavity diametrically opposed on said cylinder from said inlet.

6. A hot chamber die casting machine comprising a pot;

a cylinder extending horizontally through said pot and having a first, open end on a first outer side of said pot;

a piston slidably mounted in said cylinder;

a coolant circulation system adjacent only said first, open end of said cylinder and no other part of said cylinder.

7. The hot chamber die casting machine of claim 6 wherein said coolant circulation system is in said piston.

8. The hot chamber die casting machine of claim 6 wherein said coolant circulation system is in said cylinder.

9. The hot chamber die casting machine of claim 1 wherein said cooling means includes a fluid circulation system in said piston.

10. The hot chamber die casting machine of claim 1 wherein said cooling means includes a fluid circulation system in said cylinder.

11. The hot chamber die casting machine of claim 1 wherein said fluid circulation system includes a central bore in said piston, a hollow tube positioned concentrically in said bore and extending substantially the length thereof, an inlet to the center of said hollow tube, a port in said hollow tube near a first end of said central bore and an outlet from said central bore near a second end of said central bore.

12. The hot chamber die casting machine of claim 10 wherein said fluid circulation system includes an annular cavity about the bore of said cylinder adjacent said first, open end and inwardly of the wall of said pot, an inlet to said annular cavity, and an outlet from said annular cavity diametrically opposed on said cylinder from said inlet.

13. The hot chamber die casting machine of claim 6, wherein said coolant circulation system is in said piston.

14. The hot chamber die casting machine of claim 6, wherein said coolant circulation system is in said cylinder.

15. A hot chamber die casting machine comprising a pot;

a cylinder extending horizontally through said pot and having a first, open end on a first outer side of said pot;

a piston slidably mounted in said cylinder;

means for sealing the juncture between said piston and said first, open end, said sealing means to include means for cooling said first, open end to a temperature below the melting point of metal die casting material.

16. The hot chamber die casting machine of claim 15, wherein said cooling means includes a fluid circulation system in said piston.

17. The hot chamber die casting machine of claim 15, wherein said cooling means includes a fluid circulation system in said cylinder.

18. The hot chamber die casting machine of claim 16, wherein said fluid circulation system includes a central bore in said piston, a hollow tube positioned concentrically in said bore and extending substantially the length thereof, an inlet to the center of said hollow tube, a port in said hollow tube near a first end of said central bore and an outlet from said central bore near a second end of said central bore.

19. The hot chamber die casting machine of claim 17, wherein said fluid circulations system includes an annular cavity about the bore of said cylinder adjacent said first, open end and inwardly of the wall of said pot, an inlet to said annular cavity, and an outlet from said annular cavity diametrically opposed on said cylinder from said inlet.

20. A hot chamber die casting machine comprising a pot;

a cylinder extending horizontally through said pot and having a first, open end on a first outer side of said pot;

a piston slidably mounted in said cylinder;

means for sealing the juncture between said piston and said first, open, end of said sealing means to include a coolant circulation system adjacent said first, open end of said cylinder.

21. The hot chamber die casting machine of claim 20, wherein said coolant circulation system is in said piston.

22. The hot chamber die casting machine of claim 20, wherein said coolant circulation system is in said cylinder.

* * * * *

UNITED STATES PATENT AND TRADEMARK OFFICE

CERTIFICATE OF CORRECTION

PATENT NO. : 4,534,403

DATED : August 13, 1985

INVENTOR(S) : John I. Harvill

It is certified that error appears in the above—identified patent and that said Letters Patent is hereby corrected as shown below:

In column 8, line 25, delete "1" and insert therefor -- 9 --.

Signed and Sealed this

*Seventh* Day of *January 1986*

[SEAL]

*Attest:*

DONALD J. QUIGG

*Attesting Officer*

*Commissioner of Patents and Trademarks*